United States Patent [19]

Ishii et al.

[11] 4,357,996

[45] Nov. 9, 1982

[54] SPEED CONTROL DEVICE FOR AN ELEVATOR

[75] Inventors: Toshiaki Ishii; Takanobu Masaki, both of Inazawa, Japan

[73] Assignee: Mitsubishi Denki Kabushiki Kaisha, Tokyo, Japan

[21] Appl. No.: 137,188

[22] Filed: Apr. 4, 1980

[30] Foreign Application Priority Data

Apr. 4, 1979 [JP] Japan ..... 54/40802

[51] Int. Cl.[3] ..... B66B 1/00

[52] U.S. Cl. ..... 187/29 R; 318/328

[58] Field of Search ..... 187/29 R; 318/326–328, 318/398

[56] References Cited

U.S. PATENT DOCUMENTS

| | | | |
|---|---|---|---|
| 3,599,063 | 8/1971 | Nanai et al. | 318/327 |
| 3,948,357 | 4/1976 | Maynard et al. | 187/29 R |
| 3,983,464 | 9/1976 | Peterson | 318/328 X |
| 4,027,745 | 6/1977 | Watanabe | 187/29 R |
| 4,083,431 | 4/1978 | Oohira et al. | 187/29 R |
| 4,094,386 | 6/1978 | Suzuki et al. | 187/29 R |
| 4,124,101 | 11/1978 | Satoh | 187/29 R |

*Primary Examiner*—H. Grant Skaggs

*Attorney, Agent, or Firm*—Sughrue, Mion, Zinn, Macpeak & Seas

[57] ABSTRACT

An elevator speed control device in which the cage of the elevator can be stopped at a desired floor with a high accuracy without increasing the capacity of power supply equipment to compensate for periods of low AC source voltage. A detecting circuit produces an output signal in response to the generation of a deceleration instruction signal. This signal is converted into a short duration pulse signal which is used to set the output of an integrator included in the control circuit loop to a predetermined value.

4 Claims, 12 Drawing Figures

INSTRUCTION SPEED SIGNAL
3a
15a
to
t1
t1'
t2
t3
t4
TIME

OUTPUT OF INTEGRATOR 500
5a
V1
V2
to
t1
t2
t3
TIME

ARMATURE CURRENT
8a
to
t1
t2
t3
TIME

OUTPUT OF ACCEL./DECEL. INSTR. DET.CKT. 516
516a
516b
to
t1'
t2
TIME

OUTPUT OF TIMER 517
517a
517b
to
t2
TIME

OPERATION OF SWITCH 510
510
ON
OFF
to
TIME

OPERATION OF SWITCH 511
ON
OFF
511
t2
TIME

SPEED CONTROL DEVICE FOR AN ELEVATOR

BACKGROUND OF THE INVENTION

The present invention relates to an improved speed control device for an elevator control system employing an integrator.

A speed control device in an elevator of the general type to which the invention pertains is shown in FIGS. 1 and 2. In FIG. 1, reference numeral 1 designates a three-phase AC source, 2 a transformer, 3 a speed instruction generating device for generating a speed instruction signal 3*a*, 4 an adder which produces a difference signal 4*a*, 5 an integrator for improving the characteristics of the control system with the integrator 5 providing an output signal 5*a*, 6 a thyristor control device, 7 a thyristor converter, 8 a current detector providing an output signal 8*a* which is a current signal, 9 the armature of a DC motor, 10 the field of the DC motor, 11 the sheave of a winding machine, 12 a main cable wound on the sheave 11 with the main cable being connected to a cage 13 and a balance weight 14, and 15 a tachometer generator which is driven by the armature 9 in response to which it generates a speed signal 15*a*.

The difference signal 4*a* representing the difference between the speed instruction signal 3*a* and the speed signal 15*a* is applied to the integrator 5 as a result of which the integrator 5 produces the output signal 5*a*. The thyristor control device 6 receives the output signal 5*a* and the current signal 8*a* and from them controls the thyristor converter 7. The thyristor converter 7 converts the voltage of the three-phase AC source into a DC voltage which is applied to the armature 9. In this manner, a well-known static Reonard system is formed with which the speed of the armature, and correspondingly the lifting speed of the cage 13, is automatically controlled by the speed instruction signal 3*a* with a high accuracy.

If the voltage of the AC source 1 in the system described above is decreased for some reasons, the thyristor converter 7 cannot provide the necessary output voltage and accordingly the armature 9 will not be driven at the correct speed. This will become more apparent from the waveform diagrams of FIG. 2. As indicated in FIG. 2*a*, at the time instant $t_1$, because of a decrease in the AC source voltage, the thyristor converter 7 is saturated and the correct speed, represented by the speed signal 3*a*, cannot be provided. As a result, the output 5*a* of the integrator corresponding to the difference signal 4*a* increases after the time instant $t_1$ as shown in FIG. 2*b*. Even if the speed instruction signal 3*a* is decreased becoming a speed reduction instruction signal at the time instant $t_2$, the output 5*a* of the integrator 5 will not decrease because of its inherent integrating characteristics until the speed instruction signal 3*a* becomes smaller than the speed signal 15*a* at the time instant $t_3$. Furthermore, even when the integrator output 5*a* begins dropping, it still takes a certain period of time until it reaches the correct value so that adequate speed reduction cannot be effected satisfactorily within a sufficient time. It may then result that the cage 13 cannot be stopped at a desired floor. FIG. 2*c* shows the armature current or the current signal 8*a*.

The above-described difficulties may be overcome by a technique in which the output voltage of the transformer 2 is maintained at a high value by increasing the transformer turns ratio so that the saturation value of the thyristor converter is increased. However, this technique is disadvantageous in that the transformer 2 then becomes uneconomically large in both electrical capacity and physical size making it inconvenient to install. Moreover, increasing the voltage of the transformer 2 also undesirably reduces the power factor of the elevator control device.

SUMMARY OF THE INVENTION

Accordingly, an object of the invention is to provide an elevator speed control device in which the above-described difficulties have been eliminated and with which the cage can be stopped at a desired floor with a high accuracy without increasing the capacity of the power supply equipment such as for instance a power transformer.

In accordance with this and other object of the invention there is provided a speed control device for an elevator in which the speed of a driving electric motor is controlled according to a deceleration instruction signal applied through an integrator including a detecting circuit for detecting the generation of the deceleration instruction signal and an output setting circuit for setting an output of the integrator to a predetermined value in response to an output of the detecting circuit. In a preferred embodiment, a hysteresis or dead zone circuit is included in the input of the detecting circuit so that the detecting circuit operates only in response to signals having a value above a predetermined level.

DESCRIPTION OF THE PREFERRED EMBODIMENTS

A preferred embodiment of the invention will be described with reference to FIGS. 1, 3 and 4.

Figure 1:
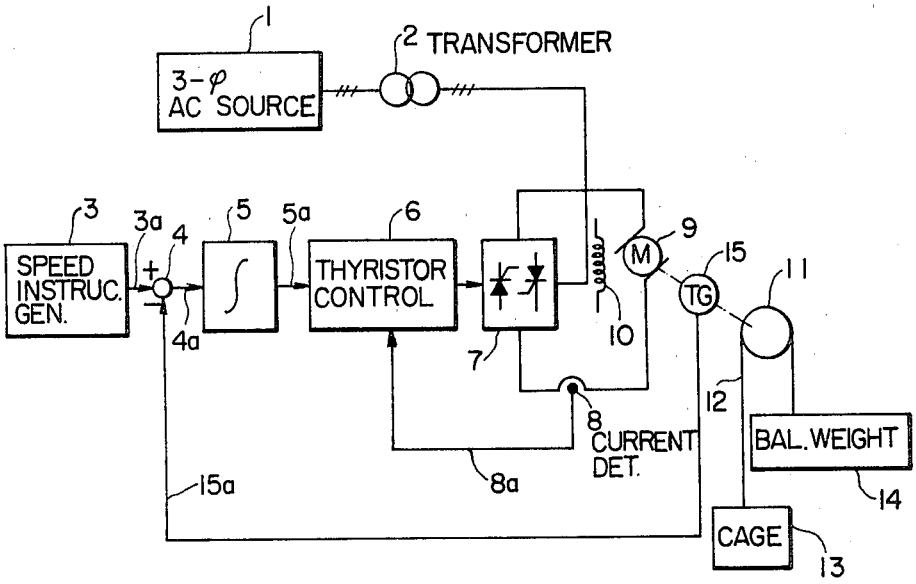
FIG. 1 PRIOR ART
FIG. 1 is a block diagram of a conventional elevator speed control device.
Figure 3:
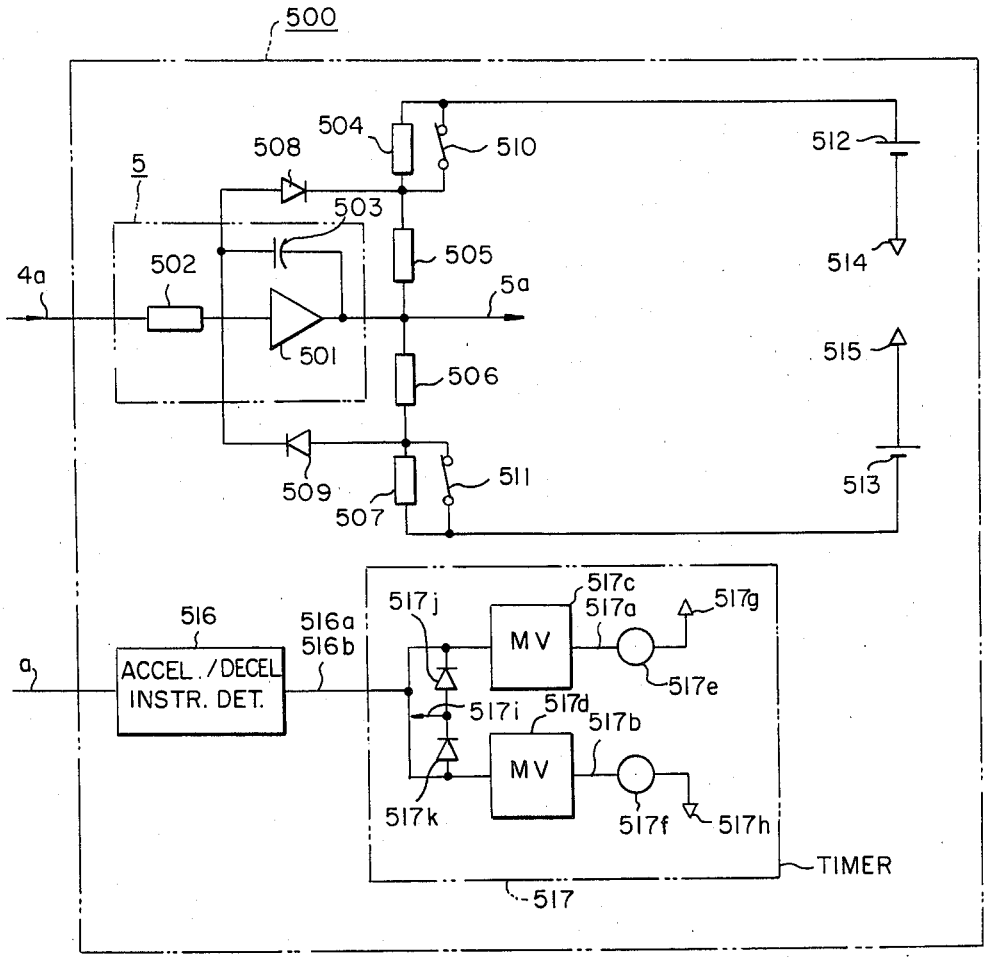
FIG. 3 is a circuit diagram of an elevator speed control device according to the invention.

In FIG. 3, reference numeral 500 designates an integration circuit which is employed in place of the integrator 5 in FIG. 1, 501 an operational amplifier, 502 a resistor, 503 a capacitor with the operational amplifier 501, the resistor 502 and the capacitor 503 forming an integrator 5 similar to that in FIG. 1, 504 throgh 507 resistors, 508 and 509 diodes. 510 and 511 normally closed switches which are opened upon application of an input control signal thereto, 512 and 513 DC sources, 514 and 515 reference potential terminals, 516 an acceleration and deceleration instruction detecting circuit of known design for detecting whether an acceleration and deceleration instruction has been issued, 516*a* and 516*b* the output signals from the circuit 516, and 517 a timer or pulse generator which produces a single pulse 517*a*, 517*b* having a predetermined short time width in reponse to each rise in the input signal 516*a*, 516*b* thereto. The components other than the integrator 5 in the integration circuit 500 form an output setting circuit. The remaining components are similar to those in FIG. 1.

Figures 4A, 4B, 4C, 4D, 4E, 4F, 4G:
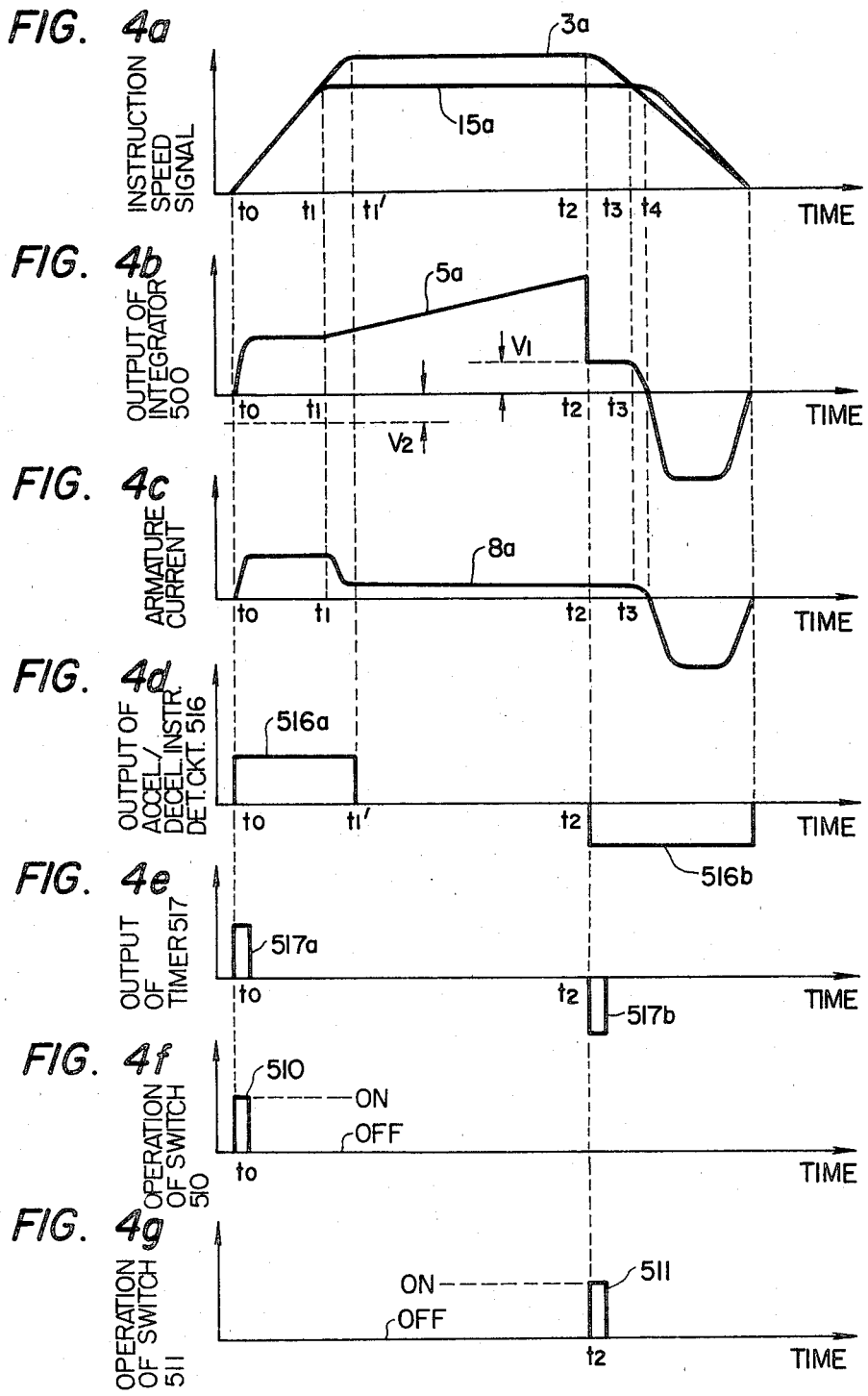
FIGS. 4*a–g* are explanatory diagrams for a description of the operation of the circuit shown in FIG. 3.

The case where the cage 13 is being wound upwardly and the speed of the cage 13 has not reached the correct value because of a reduction of the voltage of the AC source 1 will now be described. An acceleration instruction is issued during the period from $t_0$ to $t_1$. As a result, the output 516*a* of the acceleration and deceleration instruction detecting circuit 516 has a positive value as shown in FIG. 4*d*. The timer 517 generates a positive pulse 517*a* for the predetermined short operation time at the time instant $t_0$ as shown in FIG. 4*e*. As a result, the switch 510 is opened for the same predetermined short period of time as shown in FIG. 4*f*. In this case, the diode 508 is not rendered conductive because the integrated circuit output 5*a* is positive. As the switch 511 is closed, the diode 509 also cannot be rendered conductive because it is reversely biased. Accordingly, the operation of the integration circuit is not affected at all.

When the circuit 516 produces the positive output 516*a*, only the monostable multivibrator 517*c* in the timer circuit 517 is triggered to thereby produce the positive pulse signal 517*a*. In response to the positive pulse signal 517*a*, the relay coil 517*e* is deenergized to thereby open the closed switch 510. When switch 510 is opened, the cathode voltage level of the diode 508 is equal to a voltage obtained by subjecting the positive voltage of the power source 512 and the integrator output 5*a* to voltage division by the resistors 504 and 505. In this case, when the cage moves upwardly, the output 5*a* is positive during acceleration, and the diode 508 is thus reversely biased. Accordingly, the integrating capacitor is not discharged through the diode 508. Thus, no operation is effected by the timer circuit 517.

For the period of time from $t'_1$ to $t_2$, a constant running speed instruction is issued. In this case, the integration circuit output 5*a* gradually increases as shown in FIG. 4*b*. The output 516*a* of the acceleration and deceleration instruction detecting circuit 516 becomes zero at the time instant $t'_1$ as shown in FIG. 4*d*. Therefore, upon the issuance of a deceleration instruction at the time instant $t_2$, the acceleration and deceleration instruction generating circuit output 516*b* assumes a negative value as shown in FIG. 4*d* in response to which the timer 517 produces a negative pulse 517*b* for the predetermined short time. As a result, the switch 511 is opened for a predetermined period of time as shown in FIG. 4*g*. In this case, the integrator output 5*a* will be positive. Therefore, the diode 509 becomes forwardly biased and is rendered conductive whereupon the capacitor 503 is instantaneously discharged and as a result the integrator output 5*a* is set to a value $V_1$ defined by the resistors 506 and 507 as shown in FIG. 4*b*.

More specifically, upon the issuance of a decleration instruction at the time instant t2, the circuit 516 produces the negative output 516*b* in response to which only the multivibrator 517*d* in the timer circuit 517 is triggered to thereby produce the negative pulse output 517*b*. In this case, the relay coil 517*f* is deenergized during the negative output pulse 517 so as to open the switch 511. When the switch 511 is opened, the anode voltage of the diode 509 is a voltage obtained by subjecting the negative source voltage 513 and the integrator output 5*a* (being positive when the cage moves upwardly) to voltage devision by the resistors 506 and 507. When the output 5*a* exceeds a predetermined value, the diode 509 is forwardly biased. As a result, the integrating capacitor 503 is discharged through the resistor 506 and the diode 509 until the diode is reversely biased. In response to the discharge, the output 5*a* is also reduced to the predetermined value V1. After a certain period of time, in the case where the negative pulse 517 is eliminated so as to close the switch 511 again, the resistor is coupled through the switch 511 to the negative source again. Consequently, the diode is reversely biased, and thus the integrator 5 continues to operate in a normal condition.

Figures 2A, 2B, 2C:
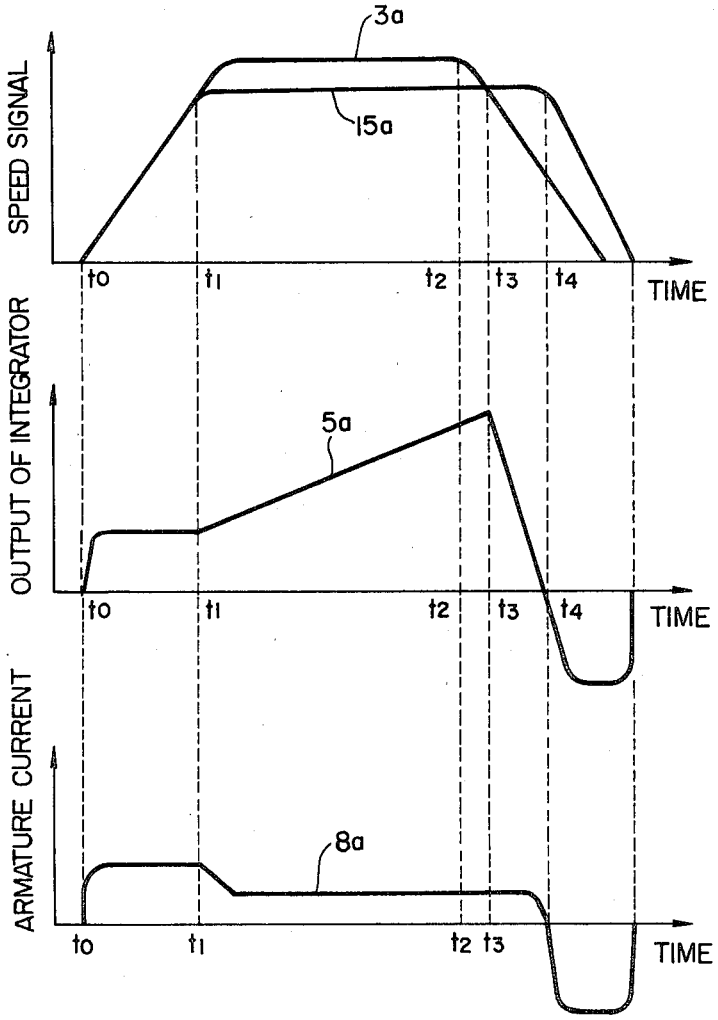
FIGS. 2*a–c* are explanatory diagrams for a description of the operation of the device shown in FIG. 1.

At the time instant $t_4$, deceleration is started with the time corresponding to the delay time from $t_2$ to $t_4$ as shown in FIG. 4*a* considerably reduced with respect to that in the prior art system as indicated by the time from $t_2$ to $t_4$ in FIG. 2*a*. Thus, even if the voltage of the AC source 1 is decreased, deceleration will nonetheless be effected without delay and, accordingly, the cage 13 can be stopped accurately at a desired floor. Furthermore, since the voltage of the transformer 2 is maintained unchanged, it is unnecessary to increase the capacitance and size of the transformer 2 and the difficulty of power factor reduction is eliminated with the use of the invention.

As the circuit operates similarly to the abovedescribed case when the cage moves downwardly, a description of that operation is unnecessary and will be omitted.

In a variation of the embodiment described above, the acceleration and deceleration instruction detecting circuit 516 is provided with slight hysteresis or small dead zone so that it will not be operated by inputs smaller than a predetermined value. In other words, since the speed instruction signal 3*a* is not completely constant for the time period from $t'_1$ to $t_2$, the acceleration and deceleration instruction detecting circuit 516 may operate erroneously. However, by providing a hysteresis or dead zone by disposing a circuit of well-known construction for performing this function in the input of the circuit such erroneous operation can be prevented.

As is apparent from the above description, according to the invention, the output of the integrator in the control circuit is set to a predetermined value when the deceleration instruction signal is issued. Therefore, even if the supply voltage is decreased, the cage can be stopped at a desired floor with high accuracy and the difficulties accompanying a conventional system in which the capacity of the power equipment must be increased beyond that required for normal operation is eliminated.

Furthermore, according to the invention, the deceleration instruction detecting circuit is so designed that it will not be operated by an input of less than predetermined value. Therefore, the output setting circuit will never be operated erroneously even if the deceleration instruction signal is slightly variable.

What is claimed is:

1. A speed control device for an elevator in which the speed of a driving electric motor is controlled according to a deceleration instruction signal applied through an integrator comprising:

a detecting circuit for detecting the generation of said deceleration instruction signal and producing an output indicative thereof; and an integrator output setting circuit for setting an output of said integrator to a predetermined value in response to said output of said detecting circuit when the output of said integrator exceeds the predetermined value, and for passing the output of said integrator therethrough when the output of said integrator is lower than the predetermined value.

2. The device as claimed in claim 1 in which the output of said integrator is set to said predetermined value for a predetermined short period of time.

3. A speed control device for an elevator in which the speed of a driving electric motor is controlled according to a deceleration instruction signal applied through an integrator comprising:

a detecting circuit for detecting the generation of said deceleration instruction signal, said detecting circuit operating to produce an output only in response to deceleration instruction signals having a value above a first predetermined value; and an integrator output setting circuit for setting an output of said integrator to a second predetermined value in response to said output of said detecting circuit when the output of said integrator exceeds the second predetermined value, and for passing the output of said integrator therethrough when the output of said integrator is lower than the second predetermined value.

4. A speed control device for an elevator in which the speed of the driving electric motor is controlled according to a deceleration instruction signal comprising:

an operational amplifier, a first resistor and a capacitor connected to form an integrator;

a detecting circuit for detecting the generation of said deceleration instruction signal;

a pulse generator circuit having an input coupled to an output of said detecting circuit, said pulse generator circuit producing a positive pulse of a first predetermined time width in response to a first input condition from said detecting circuit and producing a negative pulse of a second predetermined width in response to a second input condition from said detecting circuit;

a first diode having an anode connected to an input of said integrator;

a second transistor having a first terminal connected to an output of said integrator and a second terminal connected to a cathode of said first diode;

a third resistor having a first terminal connected to the junction between said cathode of said first diode and said second terminal of said second resistor and a second terminal connected to a first DC reference source;

first switch means having first and second terminals connected across said third resistor and a control input coupled to an output of said pulse generator circuit;

a second diode having a cathode coupled to said input of said integrator;

a fourth resistor having a first terminal connected to said output of said integrator and a second terminal coupled to the cathode of said second diode;

a fifth resistor having a first terminal connected to the junction between said anode of said second diode and said second terminal of said fourth resistor and a second terminal connected to a second DC reference source; and second switch means operatively connected across said fifth resistor and having a control terminal coupled to said output of said pulse generator circuit.

* * * * *